US006988924B2

(12) United States Patent
Ramamoorthi et al.

(10) Patent No.: US 6,988,924 B2
(45) Date of Patent: Jan. 24, 2006

(54) METHOD OF MAKING A GETTER STRUCTURE

(75) Inventors: Sriram Ramamoorthi, Corvallis, OR (US); Zhizhang Chen, Corvallis, OR (US); John Liebeskind, Corvallis, OR (US); Ronald L. Enck, Corvallis, OR (US); Jennifer Shih, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 10/412,918

(22) Filed: Apr. 14, 2003

(65) Prior Publication Data

US 2004/0203313 A1 Oct. 14, 2004

(51) Int. Cl.

| | |
|---|---|
| ***H01J 9/00*** | (2006.01) |
| ***H01J 1/38*** | (2006.01) |
| ***H01J 13/00*** | (2006.01) |
| ***H01K 1/04*** | (2006.01) |

(52) U.S. Cl. ..... 445/31; 313/553

(58) Field of Classification Search ..... 313/546, 313/553, 554, 558, 559, 561; 445/9, 21, 445/31

See application file for complete search history.

(56) References Cited

U.S. PATENT DOCUMENTS

| | | | | |
|---|---|---|---|---|
| 4,571,158 A | * | 2/1986 | Maegdefessel | 417/51 |
| 4,710,344 A | | 12/1987 | Ward et al. | |
| 5,223,766 A | * | 6/1993 | Nakayama et al. | 313/495 |
| 5,293,511 A | | 3/1994 | Poradish et al. | |
| 5,453,659 A | | 9/1995 | Wallace et al. | |
| 5,485,019 A | * | 1/1996 | Yamazaki et al. | 257/57 |
| 5,610,438 A | | 3/1997 | Wallace et al. | |
| 5,614,785 A | * | 3/1997 | Wallace et al. | 313/496 |
| 5,701,008 A | | 12/1997 | Ray et al. | |
| 5,729,086 A | | 3/1998 | Jeong | |
| 5,772,404 A | | 6/1998 | Carella | |
| 5,934,964 A | | 8/1999 | Carella et al. | |
| 5,964,630 A | * | 10/1999 | Slusarczuk et al. | 445/25 |
| 6,008,576 A | | 12/1999 | Nakatani | |
| 6,042,443 A | | 3/2000 | Carella et al. | |
| 6,057,636 A | | 5/2000 | Sakai | |
| 6,127,777 A | | 10/2000 | Watkins et al. | |
| 6,139,390 A | | 10/2000 | Pothoven et al. | |
| 6,194,830 B1 | | 2/2001 | Cho et al. | |
| 6,396,207 B1 | * | 5/2002 | Hasegawa et al. | 313/495 |
| 6,486,610 B2 | | 11/2002 | Kojima | |
| 6,787,982 B2 | | 9/2004 | Ryu | |

FOREIGN PATENT DOCUMENTS

| | | |
|---|---|---|
| EP | 1273645 A1 | 1/2003 |
| WO | WO01/80273 A1 | 10/2001 |

* cited by examiner

*Primary Examiner*—Mariceli Santiago
*Assistant Examiner*—Elizabeth Rielley
(74) *Attorney, Agent, or Firm*—Donald J. Coulman

(57) ABSTRACT

A method of manufacturing a getter structure, including forming a support structure having a support perimeter, where the support structure is disposed over a substrate. In addition, the method includes forming a non-evaporable getter layer having an exposed surface area, where the non-evaporable getter layer is disposed over the support structure, and includes forming a vacuum gap between the substrate and the non-evaporable getter layer. The non-evaporable getter layer extends beyond the support perimeter of the support structure increasing the exposed surface area.

38 Claims, 12 Drawing Sheets

METHOD OF MAKING A GETTER STRUCTURE

BACKGROUND

Description of the Art

The ability to maintain a low pressure or vacuum for a prolonged period in a microelectronic package is increasingly being sought in such diverse areas as displays technologies, micro-electro-mechanical systems (MEMS) and high density storage devices. For example, computers, displays, and personal digital assistants may all incorporate such devices. Many vacuum packaged devices utilize electrons to traverse some gap to excite a phosphor in the case of displays, or to modify a media to create bits in the case of storage devices, for example.

One of the major problems with vacuum packaging of electronic devices is the continuous outgassing of hydrogen, water vapor, carbon monoxide, and other components found in ambient air, and from the internal components of the electronic device. Typically, to minimize the effects of outgassing one uses gas-absorbing materials commonly referred to as getter materials. Generally a separate cartridge, ribbon, or pill incorporates the getter material that is then inserted into the electronic vacuum package. In addition, in order to maintain a low pressure, over the lifetime of the vacuum device, a sufficient amount of getter material must be contained within the cartridge or cartridges, before the cartridge or cartridges are sealed within the vacuum package.

Providing an auxiliary compartment situated outside the main compartment is one alternative others have taken. The auxiliary compartment is connected to the main compartment such that the two compartments reach largely the same steady-state pressure. Although this approach provides an alternative to inserting a ribbon or cartridge inside the vacuum package, it still results in the undesired effect of producing either a thicker or a larger package. Such an approach leads to increased complexity and difficulty in assembly as well as increased package size. Especially for small electronic devices with narrow gaps, the incorporation of a separate cartridge also results in a bulkier package, which is undesirable in many applications. Further, the utilization of a separate compartment increases the cost of manufacturing because it is a separate part that requires accurate positioning, mounting, and securing to another component part to prevent it from coming loose and potentially damaging the device.

Depositing the getter material on a surface other than the actual device such as a package surface is another alternative approach taken by others. For example, a uniform vacuum can be produced by creating a uniform distribution of pores through the substrate of the device along with a uniform distribution of getter material deposited on a surface of the package. Although this approach provides an efficient means of obtaining a uniform vacuum within the vacuum package, it also will typically result in the undesired effect of producing a thicker package, because of the need to maintain a reasonable gap between the bottom surface of the substrate and the top surface of the getter material to allow for reasonable pumping action. In addition, yields typically decrease due to the additional processing steps necessary to produce the uniform distribution of pores.

If these problems persist, the continued growth and advancements in the use electronic devices, in various electronic products, seen over the past several decades, will be reduced. In areas like consumer electronics, the demand for cheaper, smaller, more reliable, higher performance electronics constantly puts pressure on improving and optimizing performance of ever more complex and integrated devices. The ability, to optimize the gettering performance of non-evaporable getters may open up a wide variety of applications that are currently either impractical, or are not cost effective. As the demands for smaller and lower cost electronic devices continues to grow, the demand to minimize both the die size and the package size will continue to increase as well.

DESCRIPTION OF THE PREFERRED EMBODIMENTS

Figure 1A:
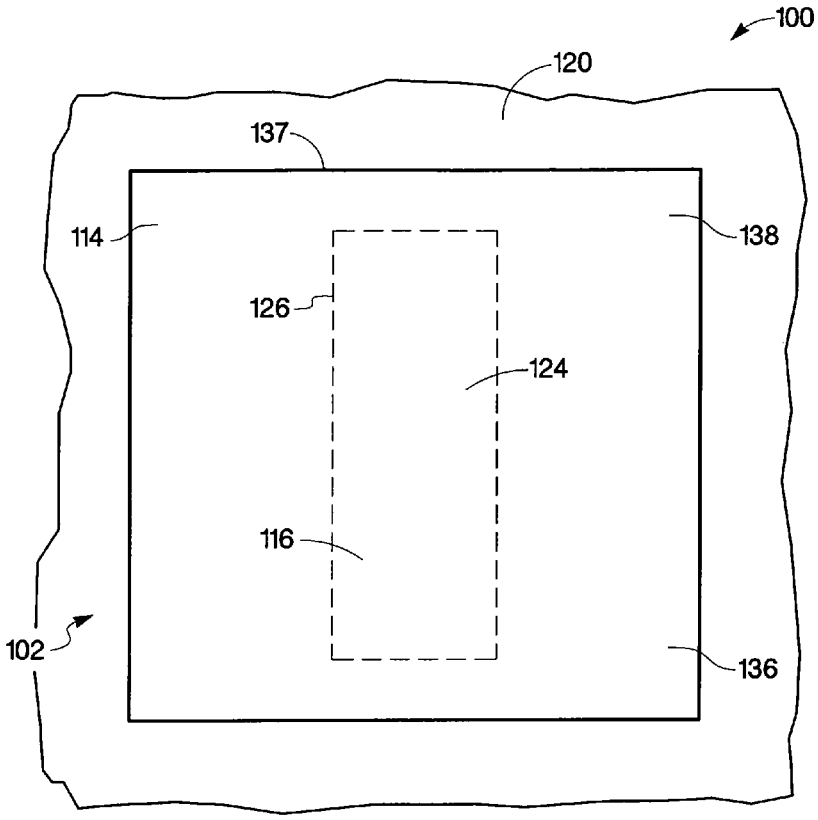
FIG. 1*a* is a top view of a getter structure according to an embodiment of the present invention.

Referring to FIG. 1*a*, an embodiment of vacuum device 100 of the present invention, in a top view, is shown. Getter structure 102 is utilized as a vacuum pump to maintain a vacuum or pressure below atmospheric pressure for vacuum device 100. Vacuum device 100 may be incorporated into any device utilizing a vacuum, such as, electronic devices, MEMS devices, mechanical devices, and optical devices to name a few. For example vacuum device 100 may be a storage device or a display device utilizing an electron emitter. As electronic manufacturers look for higher orders of integration to reduce product costs, typically, package sizes get smaller leaving less room for getter material. Electronic circuits and devices disposed on a wafer or substrate limit the area available for getter structures. This limited area increases the desire to fabricate getters with high surface area structures having a small footprint on the substrate or wafer. In addition, in those embodiments utilizing wafer-level packaging, a technique that is becoming more popular for its low costs, placing a higher surface area getter structure directly on the wafer, both simplifies the fabrication process, as well as lowers costs.

Figure 1B:
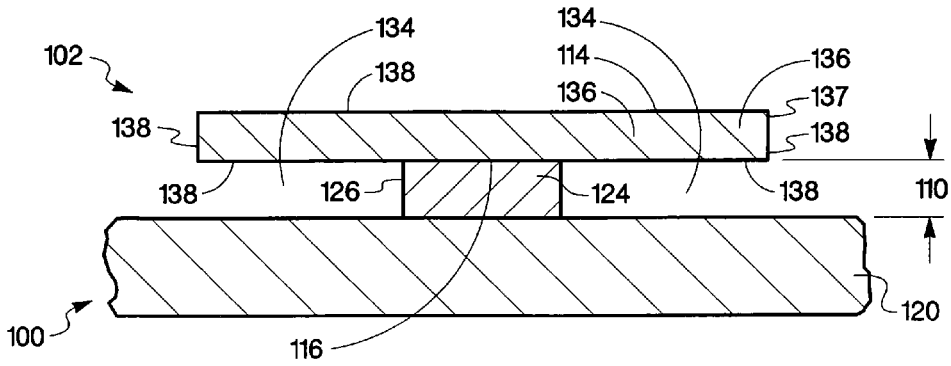
FIG. 1*b* is a cross-sectional view of the getter structure shown in FIG. 1*a* according to an embodiment of the present invention.

In this embodiment, getter structure 102 includes support structure 124 disposed on substrate 120 and non-evaporable getter layer 136 (hereinafter NEG layer 136), is disposed on support structure 124. NEG layer 136 also includes exposed surface area 138. Support structure 124, in this embodiment, has support perimeter 126, having a rectangular shape, that is smaller than NEG layer perimeter 137 creating support undercut region 134 as shown, in a cross-sectional view, in FIG. 1*b*. In alternate embodiments, support perimeter 126 may also utilize shapes such as square, circular, polygonal or other shapes. In addition, NEG layer perimeter 137 may also utilize various shapes. Further, support structure 124, in this embodiment, is centered under NEG layer 136, however, in alternate embodiments, support structure 124 may be located toward one edge or at an angle such as at one set of corners of a diagonal to a rectangular or square shaped NEG layer, for example. NEG layer 136, by extending beyond support perimeter 126, increases exposed surface area 138 of NEG layer 136 and generates vacuum gap 110, as shown in FIG. 1*b*. Vacuum gap 110 provides a path for gas molecules or particles to impinge upon the bottom or the substrate facing surface of NEG layer 136, thus increasing the exposed surface area available for pumping residual gas particles thereby increasing the effective pumping speed of getter structure 102. Vacuum gap 110, in this embodiment, is about 2.0 micrometers, however, in alternate embodiments vacuum gap 110 may range from about 0.1 micrometer to about 20 micrometers. In still other embodiments, vacuum gap 110 may range up to 40 micrometers wide. Support structure 124, in this embodiment, has a thickness of about 2.0 micrometers, however, in alternate embodiments, thicknesses in the range from about 0.1 micrometers to about 20 micrometers also may be utilized. In still other embodiments, thicknesses up to about 40 micrometers may be utilized.

The surface area and volume of the NEG material included in NEG layer 136 determines the getter pumping speed and capacity respectively of getter structure 102. Still referring to FIGS. 1*a*–1*b* the increase in pumping speed of getter structure 102 also may be illustrated by examining the relationship between the getter layer area 114 (i.e. $A_g$) and support area 116 (i.e. $A_s$). For a single NEG layer, deposited directly on the substrate, an effective surface area for pumping of $A_g$ plus the perimeter or edge surface area is provided. Whereas by inserting support structure 124 between NEG layer 136 and substrate 120, and ignoring, or assuming constancy of, the edge surface area we have an effective surface area for pumping of $A_g$ (for the top surface) plus $(A_g-A_s)$ (for the bottom surface) or combining the two we find $2A_g-A_s$. For example, if $A_s$ is one fourth the area of NEG layer 136 then we have increased the effective surface area for pumping by 1.75 over a single layer deposited on the substrate assuming that the layer thickness and thus edge surface area is constant between the two different structures.

Examples of getter materials that may be utilized include titanium, zirconium, thorium, molybdenum and combinations of these materials. In this embodiment, the getter material is a zirconium-based alloy such as Zr—Al, Zr—V, Zr—V—Ti, or Zr—V—Fe alloys. However, in alternate embodiments, any material having sufficient gettering capacity for the particular application in which vacuum device 100 will be utilized also may be used. NEG layer 136 is applied, in this embodiment, using conventional sputtering or vapor deposition equipment, however, in alternate embodiments, other deposition techniques such as electroplating, or laser activated deposition also may be utilized. In this embodiment, NEG layer 136 has a thickness of about 2.0 micrometers, however, in alternate embodiments, thicknesses in the range from about 0.1 micrometers to about 10 micrometers also may be utilized. In still other embodiments thicknesses up to about 20 micrometers may be utilized. Support structure 124, in this embodiment, is formed from a silicon oxide layer, however, in alternate embodiments, any material that will either not be severely degraded or damaged during activation of the NEG material in NEG layer 126 also may be utilized. In still other embodiments, any material that has a high degree of etch selectivity to the NEG material used also may be utilized. For example, support structure 124 may be formed from various metal oxides, carbides, nitrides, or borides. Other examples include forming support structure 124 from metals including NEG materials which has the advantage of further increasing the pumping speed and capacity of getter structure 102. Substrate 120, in this embodiment, is silicon, however, any substrate suitable for forming electronic devices, such as gallium arsenide, indium phosphide, polyimides, and glass as just a few examples also may be utilized.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention.

Figure 2:
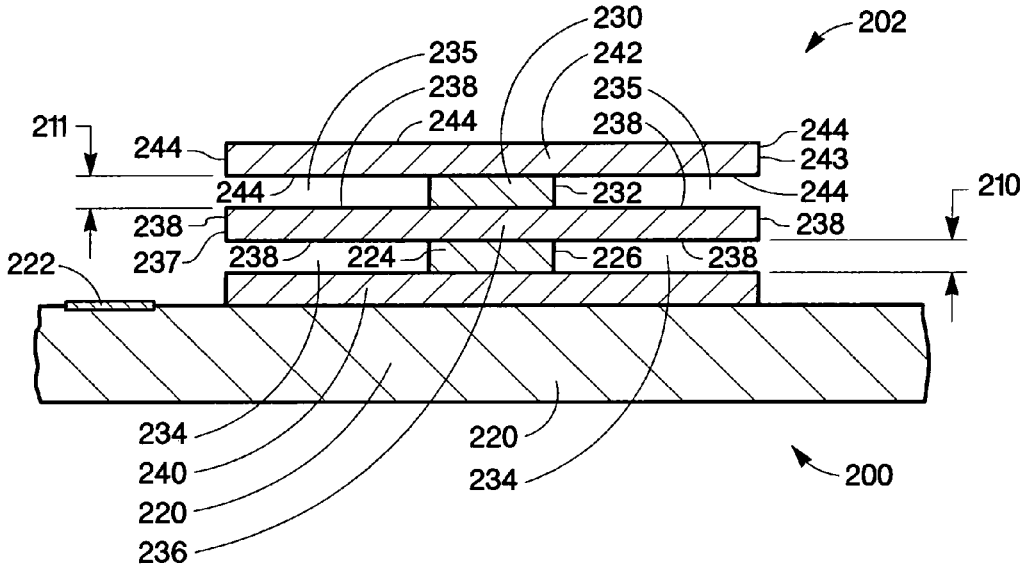
FIG. 2 is a cross-sectional view of a getter structure according to an alternate embodiment of the present invention.

Referring to FIG. 2, an alternate embodiment of vacuum device 200 of the present invention is shown in a cross-sectional view. In this embodiment, getter structure 202 includes base NEG layer 240 disposed on substrate 220 and second NEG layer 242 providing additional pumping speed and capacity as compared to a single layer structure shown in FIGS. 1*a*–1*b*. Support structure 224 has support perimeter 226 and is disposed on base NEG layer 240, second support structure 230 has second support perimeter 232 and is disposed on NEG layer 236. Second NEG layer 242 is disposed on second support structure 230.

In this embodiment, both support perimeter 226 and second support perimeter 232 have the same size perimeter, however, in alternate embodiments, both perimeters may have different perimeter sizes as well as shapes and thicknesses. Further, support perimeter 226 is smaller than NEG layer perimeter 237 creating support undercut region 234 and second support perimeter 232 is smaller than second NEG layer perimeter 243 creating second support undercut region 235. As noted above in FIG. 1*a* the particular placement, size, and shape of the support structures maybe varied, as well as different from each other. NEG layers 236 and 242 by extending beyond support perimeters 226 and 232, increase exposed surface areas 238 and 244 generating vacuum gaps 210 and 211.

As noted above for the embodiment shown in FIGS. 1*a* and 1*b* vacuum gaps 210 and 211 provide paths for gas molecules or particles to impinge upon the bottom or the substrate facing surfaces of the NEG layers increasing the exposed surface area available for pumping residual gas particles. Utilizing the same type of analysis as described above, and ignoring base NEG layer 240 for a moment; for a multi-layered getter structure, as illustrated in FIG. 2, assuming all NEG layers have the same area, all the support structures have the same area, and N represents the number of NEG layers we find the effective surface area for pumping is increased by $A_g+(N+1)(A_g-A_s)$. Thus again assuming $A_s$ is one fourth the area of the NEG layers, as an example, we have increased the effective surface area for pumping by $3.25\times A_s$ over a single layer deposited on the substrate assuming that the layer thickness and thus edge surface areas are constant between the two structures. If we now take into account base NEG layer 240 we find the effective surface area for pumping is increased by $A_g+(N+2)(A_g-A_s)$. Thus, for the structure depicted in FIG. 2 assuming, again, $A_s$ is one fourth the area of the NEG layers, as an example, we have increased the effective surface area for pumping by $4.00\times A_s$ over a single layer deposited on the substrate assuming that the layer thicknesses and thus edge surface areas are constant between the two structures.

Still referring to FIG. 2 vacuum device 200 also includes logic devices 222 formed on substrate 220. Logic devices 222 are represented as only a single layer in FIG. 2 to simplify the drawing. Those skilled in the art will appreciate that logic devices 222 can be realized as a stack of thin film layers. In this embodiment, logic devices may be any type of solid state electronic device, such as, transistors or diodes as just a couple of examples of devices that can be utilized in an electronic device. In alternate embodiments, other devices also may be utilized either separately or in combination with the logic devices, such as sensors, vacuum devices, such as electron emitters, micro-movers, or micro-mirrors, or passive components such as capacitors and resistors. In addition, in still other embodiments, by utilizing a capping layer or planarization layer disposed over logic devices 222, getter structure 202 also may be disposed over logic devices 222.

Figure 3:
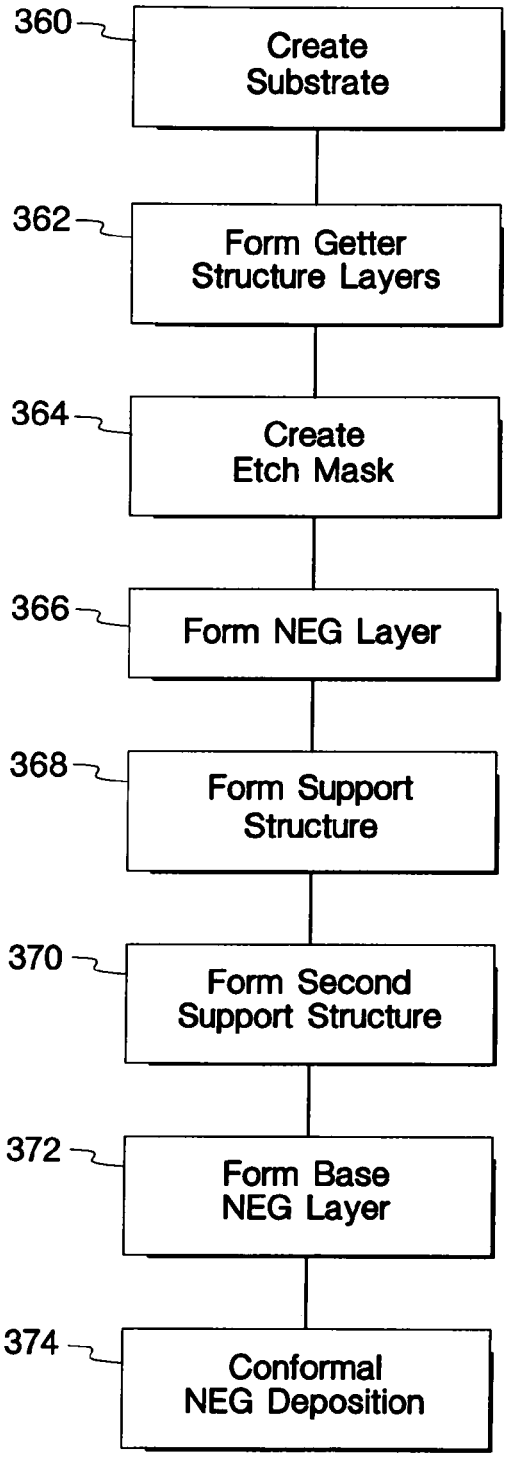
FIG. 3 is a flow chart of a method of making a getter structure according to an embodiment of the present invention.
Figure 4A:
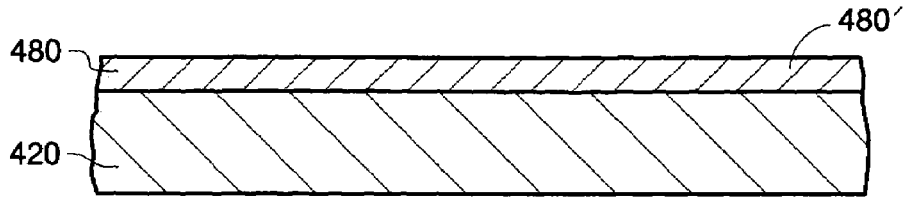
FIGS. 4*a*–4*i* are cross-sectional views of various processes used to create embodiments of the present invention.
Figure 4B:
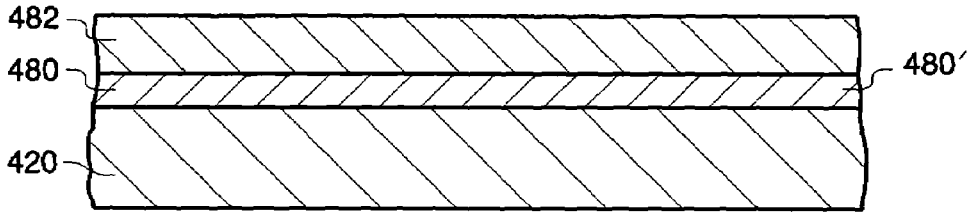
Figure 4C:
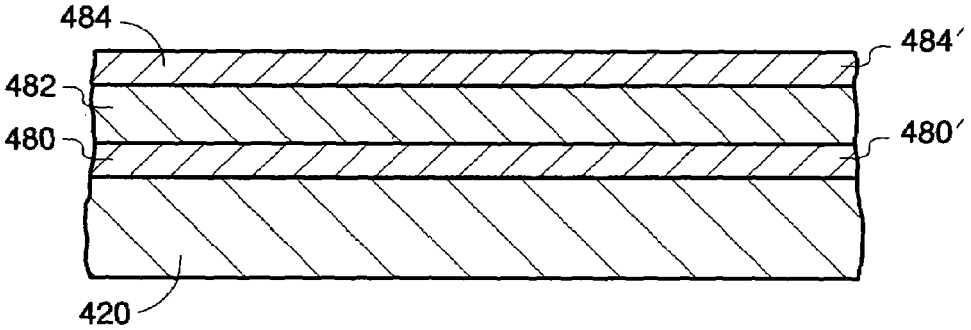
Figure 4D:
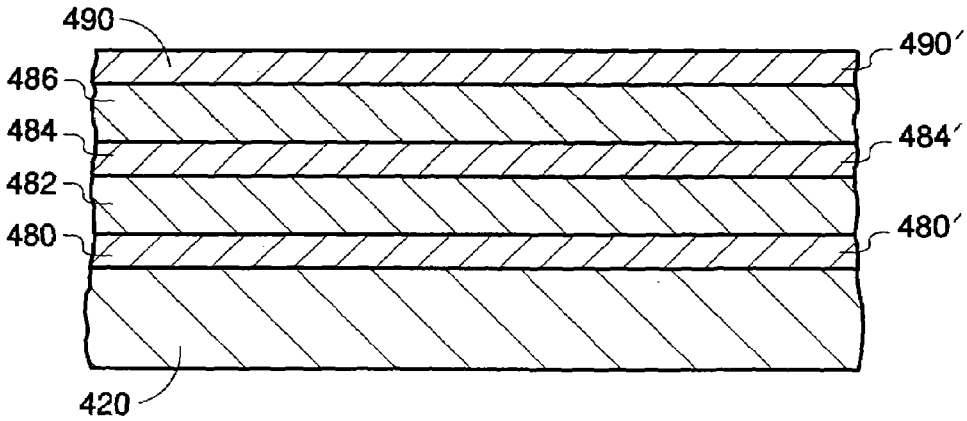
Figure 4E:
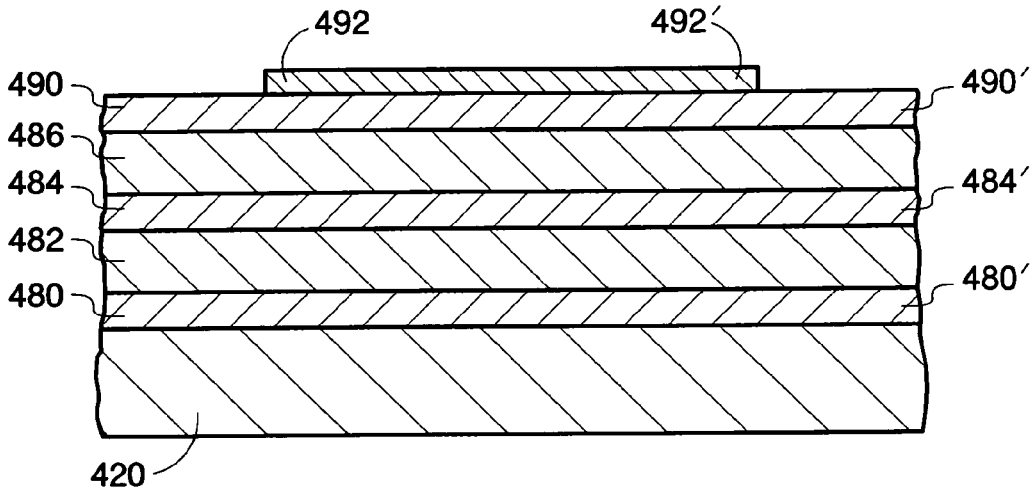
Figure 4F:
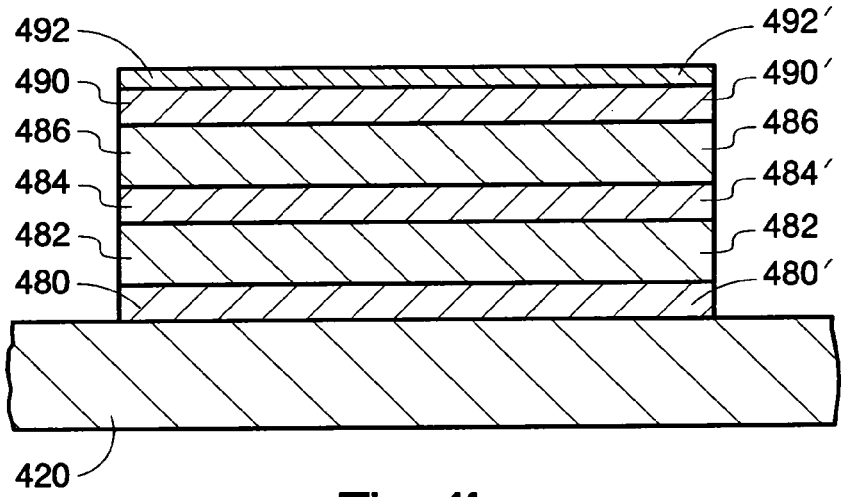
Figure 4G:
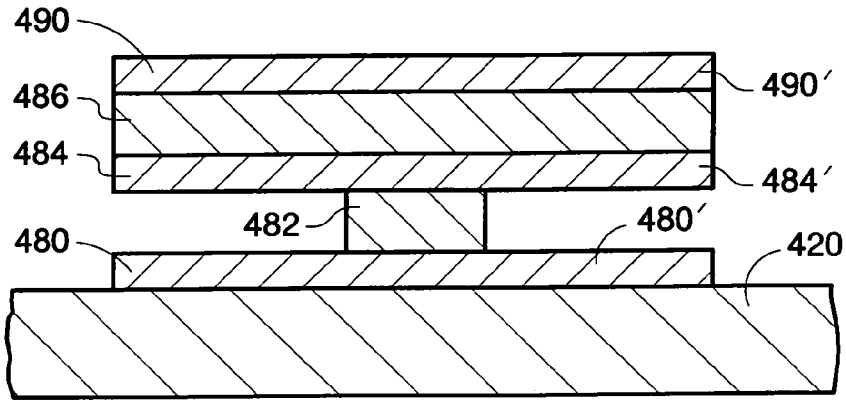
Figure 4H:
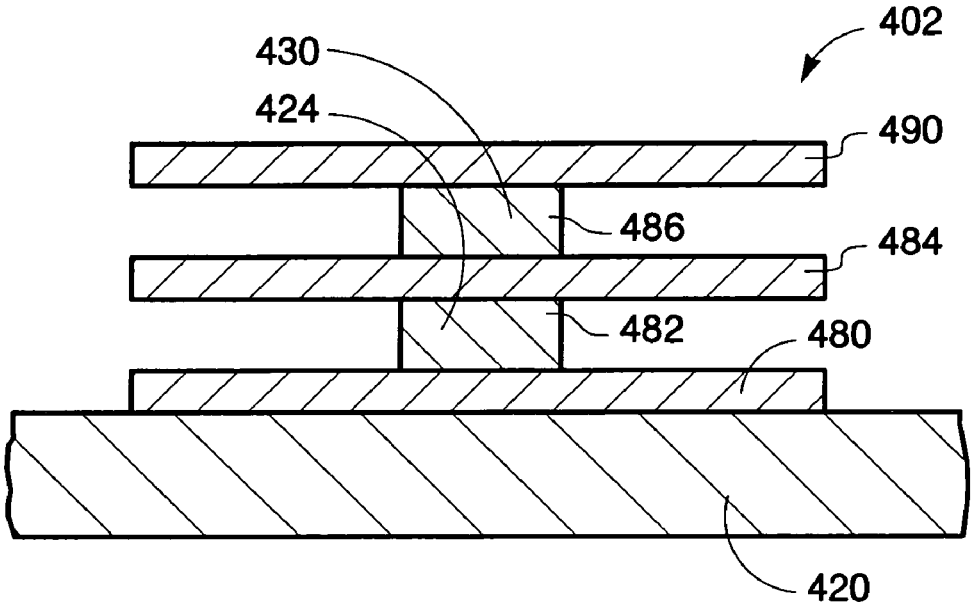
Figure 4I:
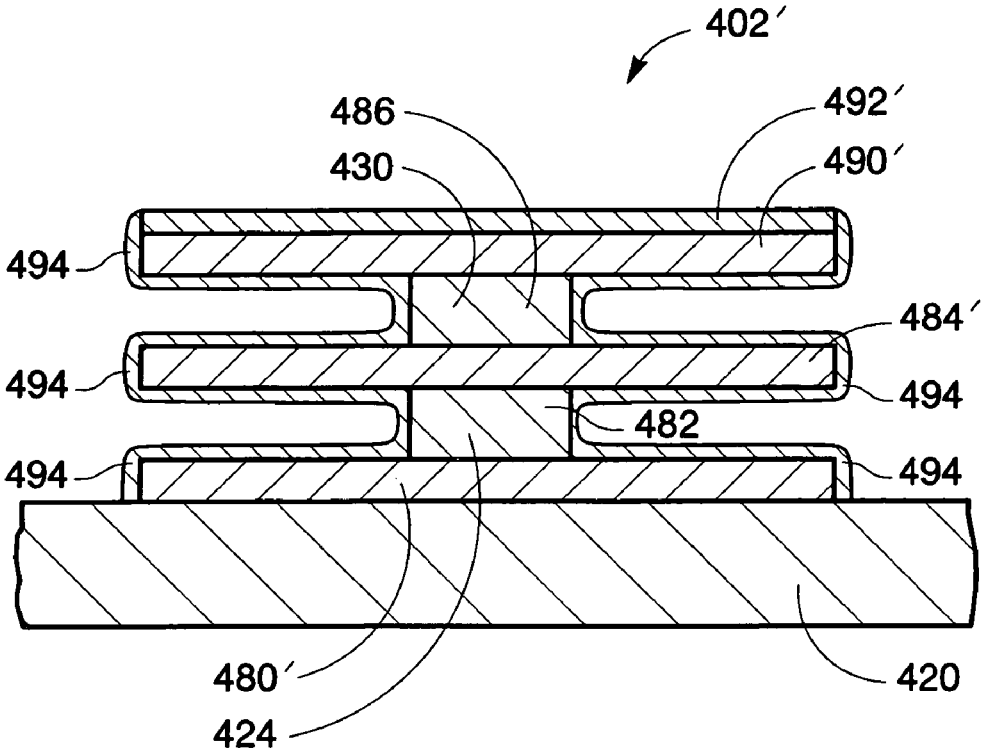
Figure 5:
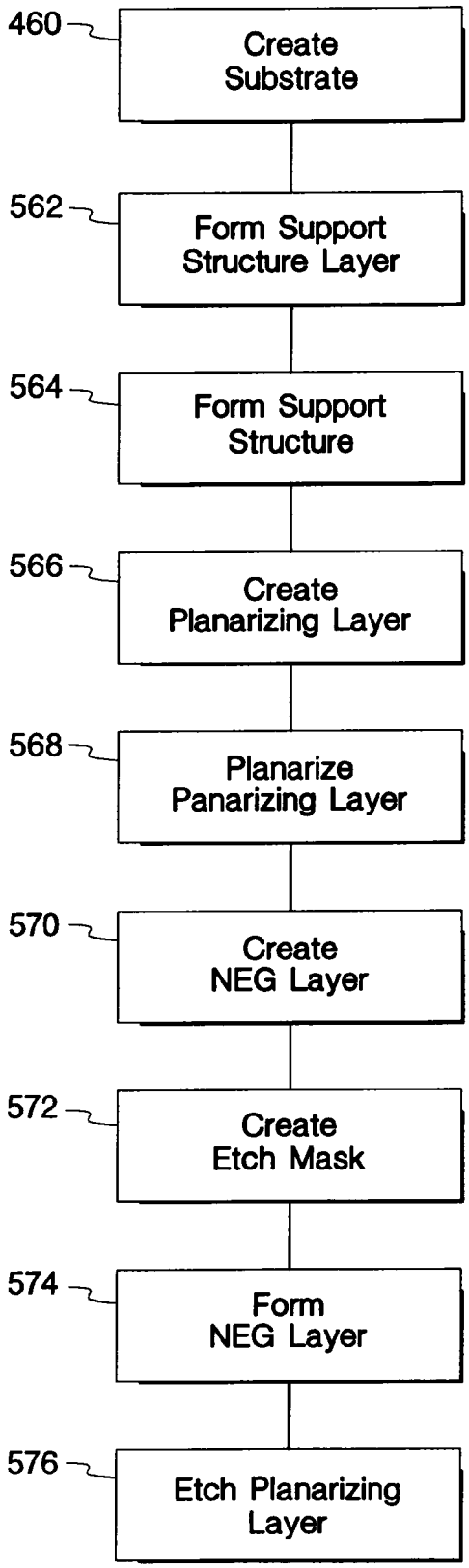
FIG. 5 is a flow chart of a method of making a getter structure according to an alternate embodiment of the present invention.

FIGS. 3 and 5 are exemplary process flow charts used to create embodiments of the present invention. FIGS. 4*a*–4*i* and 6*a*–6*h* are exemplary illustrations of the processes utilized to create a getter structure, and are shown to better clarify and understand the invention. Actual dimensions are not to scale and some features are exaggerated to more clearly point out the process.

Substrate creating process 360 is utilized to create substrate 420 (see FIG. 4*a*). Substrate 420, in this embodiment is manufactured using a silicon wafer having a thickness of about 300–700 microns. Using conventional semiconductor processing equipment, any logic devices that may be utilized in the particular application in which the getter structure is to be used are formed on substrate 420. In addition in those embodiments utilizing getter structures formed over various devices, such as logic devices, a capping layer would also be deposited over the devices. Although, in this embodiment, substrate 420 is silicon, a wide variety of other materials may also be utilized, various glasses, aluminum oxide, polyimide, metals, silicon carbide, germanium, and gallium arsenide are just a few examples. Accordingly, the present invention is not intended to be limited to those devices fabricated in silicon semiconductor materials, but will include those devices fabricated in one or more of the available semiconductor materials and technologies known in the art, such as thin-film-transistor (TFT) technology using polysilicon on glass substrates. Further, substrate creating process 360 is not restricted to typical wafer sizes, and may include processing a polymer sheet or film or glass sheet or even a single crystal sheet or a substrate handled in a different form and size than that of conventional silicon wafers.

Getter structure layers forming process 362 is utilized to form or deposit the various getter structure layers (see FIGS. 4*a*–4*d*). In this embodiment, the getter material is a zirconium-based alloy such as Zr—Al, Zr—V, Zr—V—Ti, or Zr—V—Fe alloys. The particular material utilized will depend on the particular application in which the getter structure is to be used and will depend on various parameters such as the desired base pressure, and the maximum allowable activation temperature. For example, Zr—V—Ti, or Zr—V—Fe have lower activation temperatures and thus may be utilized in those devices susceptible to thermal degradation or damage. Examples of other getter materials that also may be utilized include titanium, zirconium, thorium, hafnium, vanadium, yttrium, niobium, tantalum, and molybdenum. However, in still other embodiments, any material having sufficient gettering capacity for the particular application in which the getter structure will be utilized may also be used.

Base NEG layer 480, NEG layer 484, and second NEG layer 490 are formed, in this embodiment, using various deposition techniques such as sputter deposition, chemical vapor deposition, evaporation, or other vapor deposition techniques may be utilized, however, in alternate embodiments, other deposition techniques such as electrodeposition, or laser activated deposition may also be utilized. The particular deposition technique utilized will depend on the particular material chosen for the NEG layers. Generally the NEG layers are formed from the same material, however, some embodiments may utilize different getter materials for the NEG layers depending on the particular application in which the getter structure will be utilized. For example, base NEG layer 480 may be formed using a Zr—V—Ti alloy and NEG layer 484 and second NEG layer 490 may be formed using Zr—V—Fe, or all three layers may each be formed from a different NEG material.

Support structure layer 482 and second support structure layer 486, in this embodiment may be formed utilizing low pressure chemical vapor deposition of tetraethoxysilane (i.e. tetraethylorthosilicate (TEOS)) deposited onto, or a phosphorus doped spin on glass (SOG) spin coated onto base NEG layer 480. In those embodiments, in which base NEG layer 480 is not utilized the phosphorus doped SOG or TEOS is coated or deposited onto the top surface of substrate 420 or onto a particular layer such as a capping layer. Support structure layer 486 may be any material that is differentially etchable to the surrounding structures such as base NEG layer 480 and NEG layer 484, and will not be severely degraded or damaged during activation of the NEG material. For example, the support structure layers may be formed from various metal oxides, carbides, nitrides, borides, or various metals such as aluminum, tungsten, or gold to name just a few. Depending on the particular material being utilized to form the support structure layers any of the deposition techniques described above may be utilized. In addition other techniques such as curtain coating or plasma enhanced chemical vapor deposition also may be utilized.

In an alternate embodiment (hereinafter core layer embodiment), getter structure layers forming process 362 is utilized to form core layers, 480', 484', and 490' and support structure layers 482 and 484. In this core layer embodiment, core layers 480', 484', and 490' may be formed utilizing any of the materials described above for the support structure layers. For example, a silicon nitride or carbide may be utilized to create core layers 480', 484' and 490' and a phosphorus doped SOG or aluminum may be utilized to create support structure. In alternate core layer embodiments, the number of core layers may also be varied. A few examples that may be utilized are a single core, a single core layer coupled with a base NEG layer, or a base core layer (e.g. 480') and a supported core layer (e.g. 484'). In addition, the core layers may also be formed utilizing different materials, for example base core layer 480' may be a thermally grown silicon dioxide, core layer 484' may be a silicon nitride and second core layer 490' may be silicon carbide. Further each core layer also may be formed from a multilayer structure. For example, base core layer 480' may be formed utilizing a silicon oxide, silicon nitride, and silicon carbide layers.

Etch mask creation process 364 is utilized to deposit etch mask 492 (see FIG. 4*e*) by depositing a thin metal or dielectric layer over second NEG layer 490. The particular material utilized as etch mask 492 depends on various parameters such as the composition of the NEG material, the composition of the support structure layers, and the particular etching process used to etch the getter structure layers. Etch mask 492 may be formed from any metal, dielectric, or organic material that provides the appropriate selectivity in etching the getter structure layers. The etch mask layer may be deposited utilizing any of the conventional deposition techniques such as those described above. The particular deposition technique will depend on the particular material utilized. After the etch mask layer has been deposited photolithography and associated etch processes are used to generate the desired pattern of etch mask 492 utilizing conventional photoresist and photolithography processing equipment. Such a process is generally referred to as subtractive, i.e. the etch mask layer is removed from those areas where etching is to occur utilizing a photoresist layer and photoligthography techniques. However, in alternate embodiments, an additive process also may be utilized, and, in still other embodiments, etch mask 492 may be formed from a photoresist layer directly. In this embodiment, the pattern of etch mask 492 is utilized to generate the desired shape of NEG layer 484, and second NEG layer 490.

In the core layer embodiment, etch mask creation process 364 is also utilized to deposit etch mask 492' over second core layer 490'. However, in the core layer embodiment a NEG material may be utilized to form etch mask 492' creating both a top NEG layer and an etch mask. Whether a NEG material is utilized to form etch mask 492' will depend on various parameters such as the particular etches used to etch the getter structure layers.

NEG layer forming process 366 is utilized to etch through the getter structure layers (see FIG. 4*f*). In this embodiment, as well as the core layer embodiment, the full stack of getter structure layers are anisotropically etched through till the substrate in those areas not protected by etch mask 492 or 492'. Thus, in this embodiment, the shape or outer perimeters of NEG layer 484 and second NEG layer 490 are formed. In alternate embodiments, NEG layer 484 and second NEG layer 490 may be etched separately. For example, NEG layer 484 may be etched before second support structure layer 486 is deposited. In such an embodiment, after etching of NEG layer 484 is completed, typically a planarizing layer is applied to fill in the etched NEG material forming a planar surface onto which second support structure 486 may be deposited. The particular etch utilized will depend on various parameters such as the composition of the NEG material, the composition of the support structure layers, the thickness of the NEG layers, and the thickness of the support structure layers. Generally a dry etch utilizing reactive ion etching will be used, however, other processes such as laser ablation, or ion milling including focused ion beam patterning may also be utilized. Further combinations of wet and dry etch may also be utilized. After the etching is completed etch mask 492 or 492' may be removed using either dry or wet etching; however, depending on the material utilized to form support structure layers 482 and 486, etch mask 492 may be left on second NEG layer 490 or second core layer 490' and removed after the support structures have been formed.

Support structure forming process 368 is utilized to etch support structure layer 482 (see FIG. 4*g*). Support structure layer 482 is laterally removed by a selective etch that is selective to the material utilized to form support structure layer 482 and etches base NEG layer 480, NEG layer 484, and second NEG layer 490 at a slower rate if at all. In the core layer embodiment, an etch that either does not etch base core layer 480', core layer 484' and second core layer 490' or etches at a slower rate will be utilized. An etchant for this purpose, for phosphorus doped SOG, can be a buffered oxide etch that is essentially hydrofluoric acid and ammonium chloride. For an aluminum support structure layer sulfuric peroxide or sodium hydroxide may be utilized.

Optional second support structure forming process 370 is utilized to etch second support structure layer 486 (see FIG. 4*h*) for those embodiments utilizing different materials to form support structure layer 482 and second support structure layer 486 to form getter structure 402. Forming process 370 is also utilized in the core layer embodiment when different support structure layers are used. As described above for support structure forming process 368 an etchant is utilized that either will not etch the remaining layers or will etch the remaining layers at a slower rate.

Optional base NEG layer forming process 372 is utilized to etch base NEG layer 480 for those embodiments in which base NEG layer 480 is a different size, or shape than NEG layer 484 and second NEG layer 490. As discussed above, in such an embodiment, after etching of base NEG layer 480 is completed, typically a planarizing layer is applied to fill in the etched NEG material forming a planar surface onto which support structure 482 may be deposited. A similar process is also utilized in the core layer embodiment when base core layer 480' is a different size or shape than core layer 484' and second core 490'.

NEG conformal deposition process 374 is utilized, in the core layer embodiment, to conformally deposit NEG material 494 on the exposed surfaces of base core layer 480', core layer 484', second core layer 490', support structure 424, and second support structure 430 to form getter structure 402'. The NEG material may be any of the materials described above for the NEG layers. NEG material 494 may be formed utilizing a wide variety of deposition techniques such as glancing or low angle sputter deposition, chemical vapor deposition, ionized physical vapor deposition (PVD), or electrodeposition are just a few examples.

Although the process described above and illustrated in FIGS. 4*a*–4*i* utilizes three NEG layers it is understood that the above process may be utilized to form one and two NEG layer structures, as well as repeated multiple times to generate a multi-layered getter structure containing four or more layers.

Figure 6A:
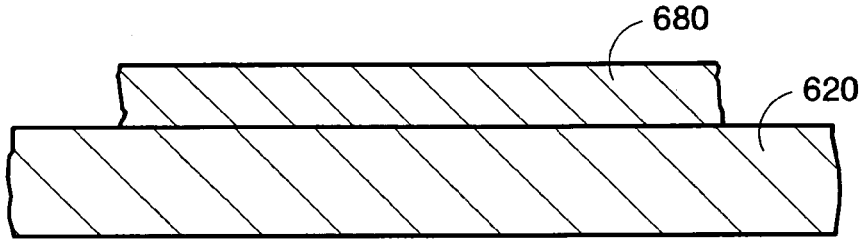
FIGS. 6*a*–6*h* are cross-sectional views of various processes used to create embodiments of the present invention.
Figure 6B:
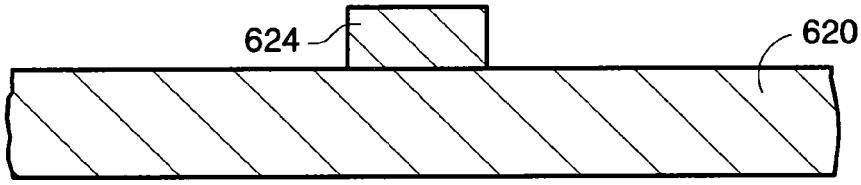

Referring to FIG. 5 substrate creating process 460 is utilized to create substrate 620 (see FIG. 6*a*). Substrate 620, in this embodiment may be any of the substrates described above. Support structure layer forming process 562 is utilized to form or deposit support structure layer 680 (see FIG.

6*a*). Any of the materials as well as deposition techniques described above either for the NEG materials or the support structures may be utilized to form support structure layer 680. Support structure forming process 564 is utilized to etch support structure layer 680 to form support structure 624 (see FIG. 6*b*). After support structure layer 680 has been deposited, photolithography and associated etch processes are used to generate the desired pattern or shape, and location of support structure 624, utilizing conventional photoresist and photolithography processing equipment. Both a subtractive process as described and an additive process (not shown) may be utilized to create support structure 524.

Figure 6C:
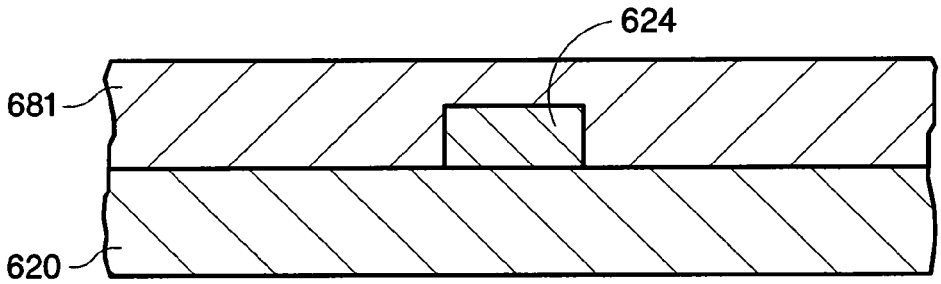
Figure 6D:
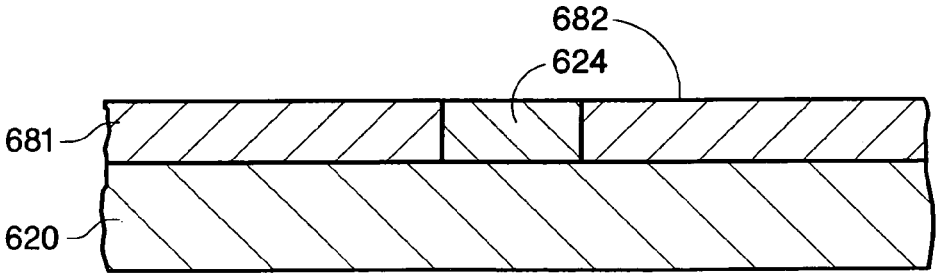

Planarizing layer creation process 566 is utilized to create planarizing layer 681 (see FIG. 6*c*). Any of the materials as well as deposition techniques described above for the support structures may be utilized to form planarizing layer 681. For example, a phosphorus doped SOG, TEOS, or aluminum may be utilized. However, any material that is differentially etchable to the surrounding structures such as NEG layer 684 (see FIG. 6*e*) substrate 620 or support structure 624, and will not be severely degraded or damaged during activation of the NEG material may be utilized. Planarizing layer planarizing process 568 is utilized to form a substantially planar surface between planarizing layer 681 and support structure 624 (see FIG. 6*d*). Planarizing layer 681 is planarized, for example, by mechanical, resist etch-back, or chemical-mechanical processes, to form substantially planar surface 682.

Figure 6E:
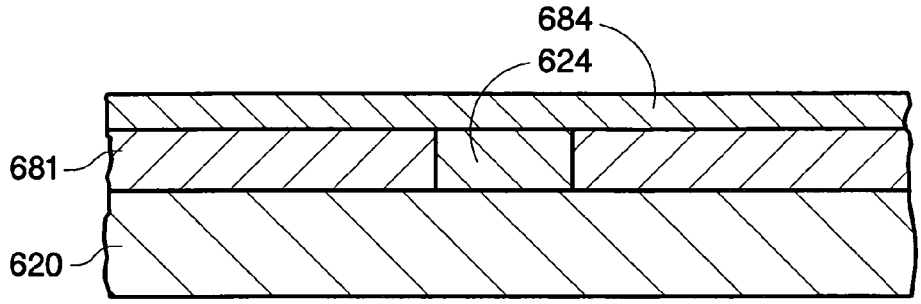
Figure 6F:
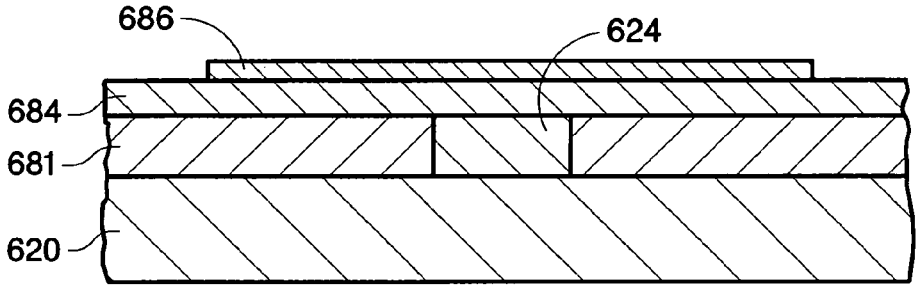

NEG layer creation process 570 is utilized to create NEG layer 684 (see FIG. 6*e*). Any of the materials as well as deposition techniques described above for NEG materials may be utilized to form NEG layer 684. Optional etch mask creation process 572 is utilized to deposit etch mask 686 (see FIG. 6*f*) by depositing a thin metal or dielectric layer over NEG layer 684. NEG layer 684, in some embodiments, may also be utilized as an etch mask. The particular material utilized as etch mask 686 depends on various parameters such as the composition of the NEG material, the composition of the support structure, the composition of the planarizing layer, and the particular etching process used to etch through NEG layer 684, and planarizing layer 681. Etch mask 686 may be formed from any metal, or dielectric material that provides the appropriate selectivity in etching the getter structure layers. The etch mask layer may be deposited utilizing any of the conventional deposition techniques such as those described above. The particular deposition technique will depend on the particular material utilized. For those embodiments, utilizing an etch mask, photolithography and associated etch processes are used to generate the desired pattern of etch mask 686 utilizing conventional photoresist and photolithography processing equipment. In this embodiment, the pattern of etch mask 686 is utilized to generate the desired shape of NEG layer 684.

Figure 6G:
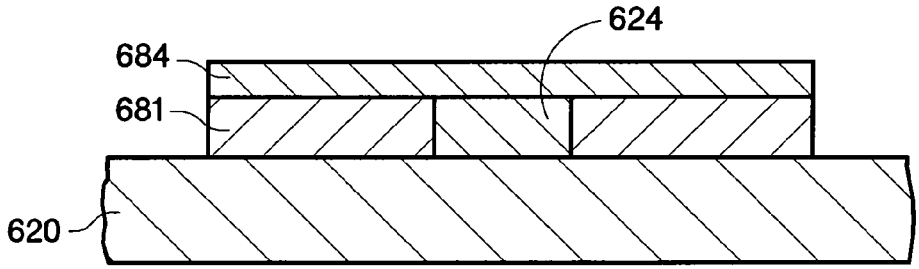

NEG layer forming process 574 is utilized to etch through the getter structure layers (see FIG. 6*g*). The full stack of getter structure layers are anisotropically etched through till the substrate in those areas not protected by etch mask 686. If NEG layer 684 is utilized as etch mask 686 then a wet etch, that is selective to the material utilized to form planarizing layer 681 may be utilized to etch through planarizing layer 681 in the unprotected regions as well as etch laterally planarizing layer 681 under NEG layer 684. Any of the etch techniques described above in NEG layer forming process 366 may also be utilized to etch through either NEG layer 684 or planarizing layer 681 or both.

Figure 6H:
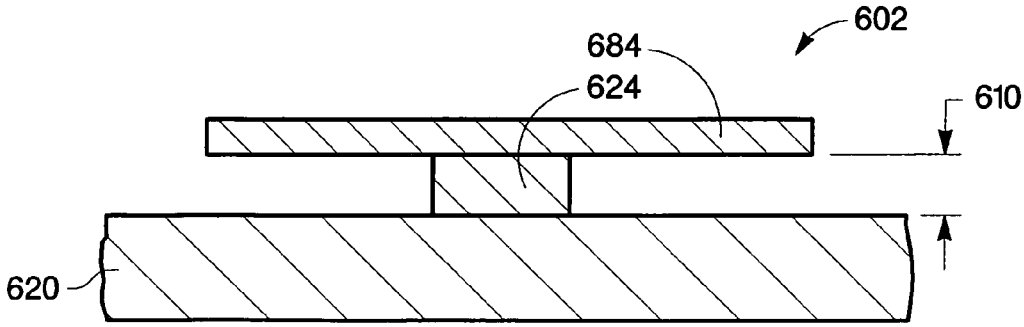

Optional planarizing layer etching process 576 is utilized to etch planarizing layer 681 (see FIG. 6*h*). Planarizing layer 681 is laterally removed by a selective etch that is selective to the material utilized to form vacuum gap 610 and getter structure 602 similar to getter structure 102 shown in FIGS. 1*a*–1*b*. As described above for support structure forming process 368 an etchant, for phosphorus doped SOG, can be a buffered oxide etch that is essentially hydrofluoric acid and ammonium chloride. For an aluminum planarizing layer sulfuric peroxide or sodium hydroxide may be utilized. Although the process described above and illustrated in FIGS. 6*a*–6*h* utilizes only one NEG layer it is understood that the above process may be repeated multiple times to generate a multi-layered getter structure.

Figure 7:
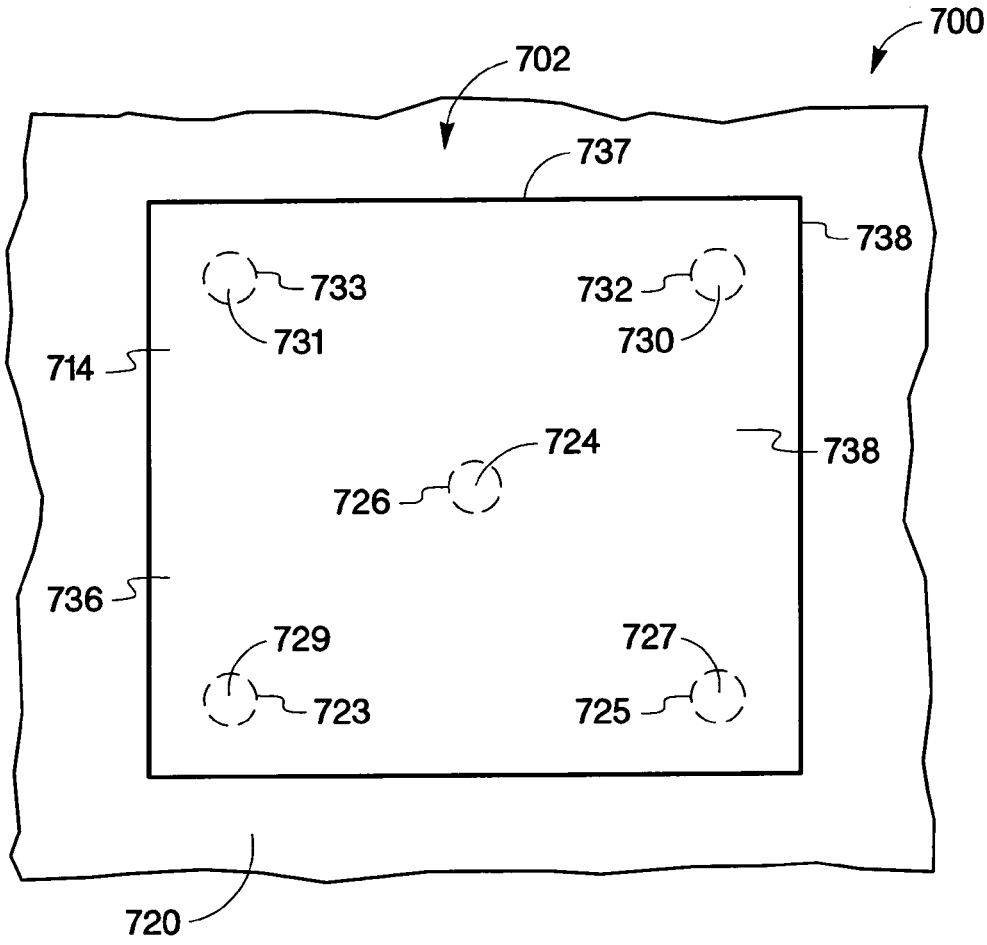
FIG. 7 is a top view of a getter structure according to an alternate embodiment of the present invention.

The processes described above and illustrated in FIGS. 4*a*–4*i* and FIGS. 6*a*–6*h* may be utilized to form a variety of getter structures such as those illustrated in FIGS. 1 and 2. Of the many possible structures that may be formed utilizing this process two additional examples are shown in FIGS. 7 and 8 to further illustrate the wide range of possible structures. Referring to FIG. 7, an alternate embodiment of a getter structure of the present invention is shown in a top view. In this embodiment, getter structure 702 includes multiple support structures 724, 727, 729, 730, and 731 disposed on substrate 720 are utilized to support NEG layer 736. Support structures 724, 727, 729, 730, and 731 include support perimeters 726, 725, 723, 732, and 733 respectively. Support structures 724, 727, 729, 730, and 731, in this embodiment, have a circular shape, and disposed within NEG layer perimeter 737 creating a vacuum gap or support undercut region (not shown). The height of the support structures determines the size of the vacuum gap. The vacuum gap or undercut region provides a path for gas molecules or particles to impinge upon the bottom or the substrate facing surface of NEG layer 736, thus increasing the exposed surface area of getter layer area 714 available for pumping residual gas particles providing an increase in the effective pumping speed of getter structure 702. In alternate embodiments, the support structures may also utilize other shapes such as rectangular, square, or polygonal as well as being disposed in other spatial arrangements.

Figure 8A:
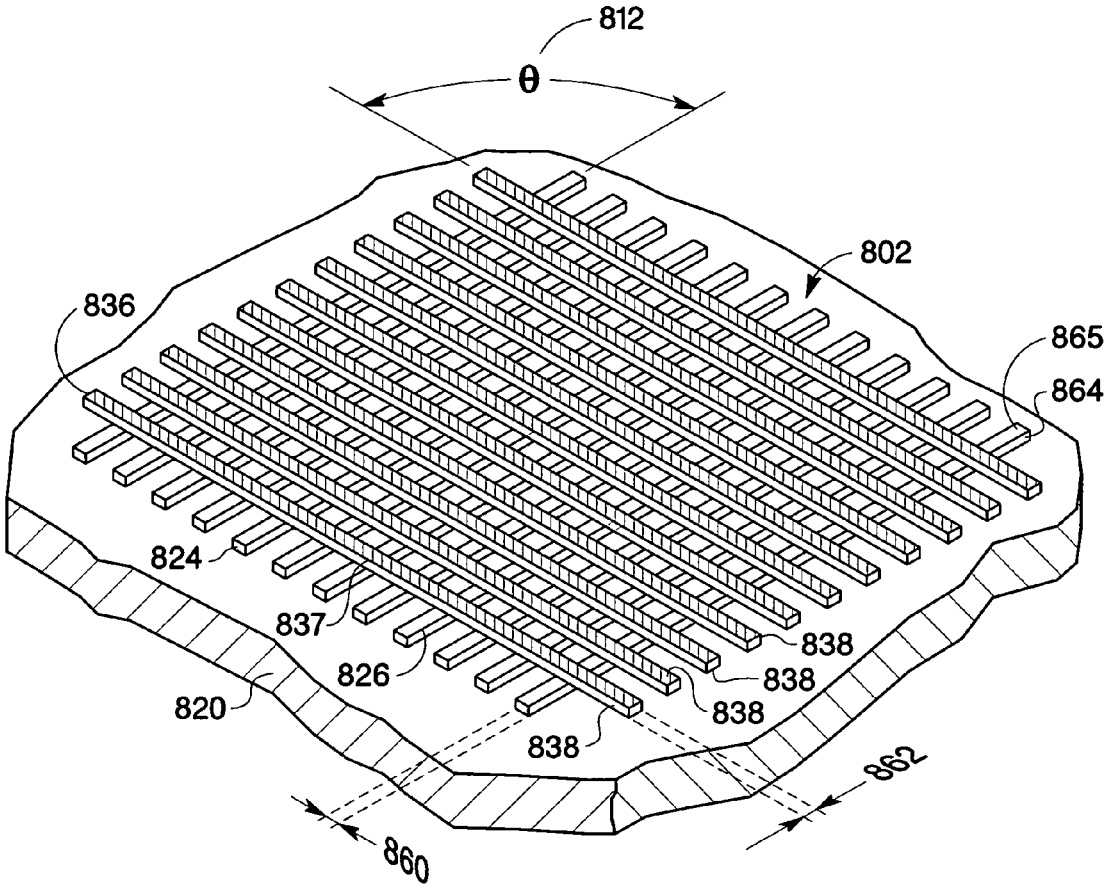
FIG. 8*a* is a perspective view of a getter structure according to an alternate embodiment of the present invention.
Figure 8B:
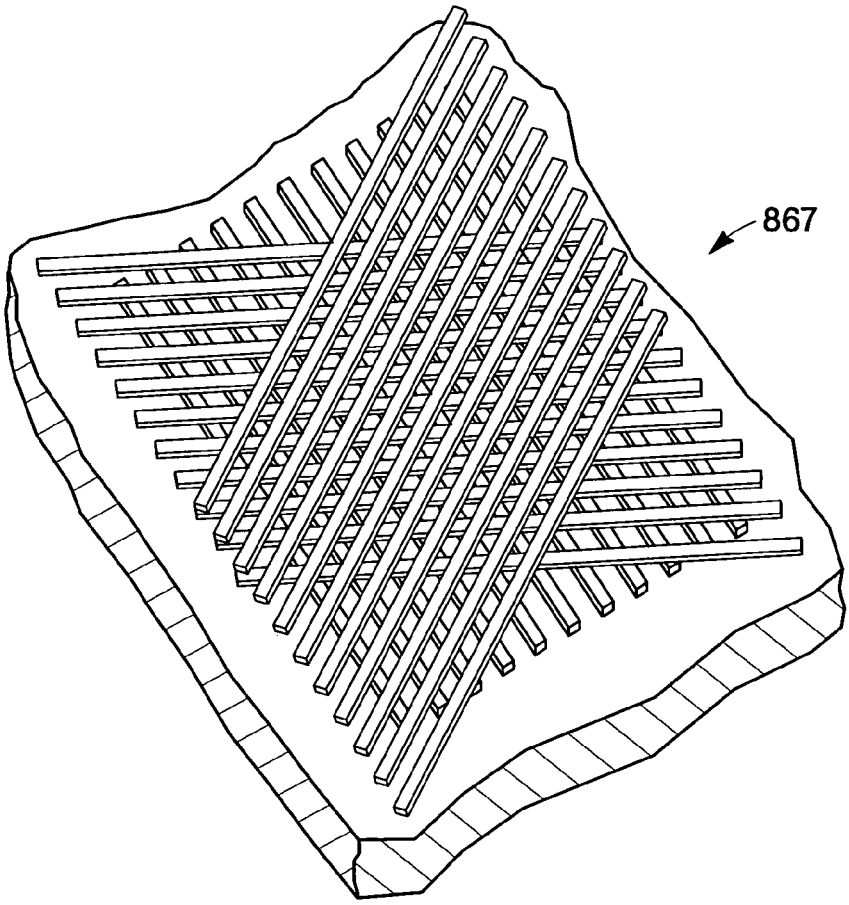
FIG. 8*b* is a perspective view of a getter structure according to an alternate embodiment of the present invention.

Referring to FIG. 8*a*, an alternate embodiment of a getter structure of the present invention, that may be formed utilizing the processes described above and illustrated in FIGS. 4*a*–4*i* and FIGS. 6*a*–6*h*, is shown in a perspective view. In this embodiment, getter structure 802 includes a plurality of NEG lines 836 disposed on a plurality of support structure lines 824. Support structure lines 824 are formed of a non-evaporable getter material and are substantially parallel to each other. NEG lines 836 are also substantially parallel to each other and are disposed at predetermined angle 812 to support structure lines 824. In this embodiment, predetermined angle 812 is about 90 degrees, however, in alternate embodiments, angles in the range from about 20 degrees to about 90 degrees also may be utilized. Support structure lines 824 are disposed on substrate 820 and have a length and width 860 forming support structure line perimeter 826. Support structure lines 824 also include exposed support line side surfaces 864 and between NEG lines 836 exposed support line top surfaces 865. In addition, NEG lines 836 also have a length and width 862 forming NEG line perimeter 837. In alternate embodiments, additional NEG lines also may be utilized to form additional multilayer structures such as hexagonal array of lines 867 as shown, in a perspective view, in FIG. 8*b*. In this embodiment, NEG lines 836 extend beyond support structure line width 860 increasing exposed surface area 838 of NEG lines 836 and generates vacuum gap (not shown) determined by the thickness of support structure lines 824. In this embodiment, the vacuum gap as well as the gaps or openings between both the NEG lines and the support lines provide a path for gas molecules or particles to impinge upon the exposed surface of both NEG lines 836 and support structure lines 824, thus increasing the exposed surface area available for pumping residual gas particles, providing an increase in the effective pumping speed of getter structure 802.

What is claimed is:

1. A method of manufacturing a getter structure, comprising:

forming a support structure having a support perimeter, said support structure disposed over a substrate;

forming a non-evaporable getter layer having an exposed surface area, said non-evaporable getter layer disposed over said support structure; and forming a vacuum gap between said substrate and said non-evaporable getter layer, said non-evaporable getter layer extending beyond said support perimeter in at least one lateral direction of said support structure increasing said exposed surface area.

2. The method in accordance with claim 1, further comprising forming a base non-evaporable getter layer interposed between said support structure and said substrate.

3. The method in accordance with claim 1, further comprising:

forming a second support structure having a second perimeter, said second support structure disposed on said non-evaporable getter layer;

forming a second non-evaporable getter layer having a second exposed surface area, said second non-evaporable getter layer disposed on said second support structure; and forming a second vacuum gap between said non-evaporable getter layer and said second non-evaporable getter layer, said second non-evaporable getter layer extending beyond said second perimeter in at least one lateral direction of said second support structure.

4. The method in accordance with claim 1, further comprises forming a folded structure having at least one fold, wherein said support structure is disposed at one edge of said non-evaporable getter layer.

5. The method in accordance with claim 4, wherein forming said folded structure, further comprises:

forming a first section from a base NEG layer;

forming a folding section from a support structure layer; and forming a second section from said non-evaporable getter layer, wherein said second section is folded back and substantially parallel to said first section, whereby a U shaped structure is formed.

6. The method in accordance with claim 1, wherein forming said support structure further comprises forming said support structure utilizing a non-evaporable getter material.

7. The method in accordance with claim 1, wherein forming said vacuum gap further comprises forming said vacuum gap in the range from about 0.1 micrometer to about 20 micrometers.

8. The method in accordance with claim 1, wherein forming said vacuum gap further comprises forming said vacuum gap in the range up to about 40 micrometers wide.

9. The method in accordance with claim 1, wherein forming said support structure further comprises forming support structure in the range from about 0.1 micrometer to about 20 micrometers.

10. The method in accordance with claim 1, wherein forming said support structure further comprises forming said support structure in the range up to about 40 micrometers wide.

11. The method in accordance with claim 1, further comprising forming a core layer interposed between said support structure and said non-evaporable getter layer.

12. The method in accordance with claim 11, further comprising forming a non-evaporable getter material substantially enclosing said core layer.

13. The method in accordance with claim 1, further comprising forming a core layer having an exposed edge surface and an exposed bottom surface, said core layer interposed between said support structure and said non-evaporable getter layer.

14. The method in accordance with claim 13, further comprising forming a non-evaporable getter material on said exposed edge surface and said exposed bottom surface of said core layer substantially enclosing said core layer by said non-evaporable getter layer.

15. The method in accordance with claim 1, further comprising forming a non-evaporable getter material on at least a portion of a support layer perimeter surface.

16. The method in accordance with claim 1, further comprising, forming a vacuum device disposed on a portion of said substrate.

17. The method in accordance with claim 1, further comprising:

forming a cover; and generating a vacuum seal attached to said substrate and to said cover wherein said vacuum seal, said substrate and said cover define an interspace region and provide a package enclosing said non-evaporable getter layer.

18. The method in accordance with claim 1, wherein forming said support structure further comprises forming said support structure from a dielectric material selected from the group consisting of silicon oxide, silicon dioxide, silicon carbide, silicon nitride, aluminum oxide and boron nitride.

19. The method in accordance with claim 1, wherein forming said non-evaporable getter layer further comprises forming said non-evaporable getter layer from a metal selected from the group consisting of molybdenum, titanium, thorium, zirconium, and combinations thereof.

20. The method in accordance with claim 1 wherein forming said non-evaporable getter layer further comprises forming said non-evaporable getter layer having a thickness in the range from about 0.1 micrometer to about 2.0 micrometers.

21. The method in accordance with claim 1, wherein forming said non-evaporable getter layer further comprises forming said non-evaporable getter layer having a thickness in the range from about 0.1 micrometer to about 20.0 micrometers.

22. The method in accordance with claim 1, wherein forming said non-evaporable getter layer further comprises forming said non-evaporable getter layer from a metal, selected from the group consisting of Zr—Al alloys, Zr—V alloys, Zr—V—Ti alloys, Zr—V—Fe alloys, and combinations thereof.

23. The method in accordance with claim 1, wherein forming said support structure further comprises forming a plurality of support structure lines formed from a non-evaporable getter material, and substantially parallel to each other, and forming said non-evaporable getter layer further comprises forming a plurality of non-evaporable getter lines substantially parallel to each other and at a predetermined angle to said plurality of support structure lines.

24. The method in accordance with claim 23, further comprising forming a plurality of second non-evaporable getter lines substantially parallel to each other and at a second predetermined angle to said plurality of said non-evaporable getter lines.

25. The method in accordance with claim 24, wherein forming said second non-evaporable getter lines, said support structure lines, and said non-evaporable getter lines further comprises forming a hexagonal array of lines.

26. The method in accordance with claim 23, wherein forming said support structure lines and said non-evaporable getter lines further comprises forming said support structure lines and said non-evaporable getter lines substantially mutually orthogonal to each other.

27. The method in accordance with claim 23, wherein forming said non-evaporable getter lines further comprises forming said non-evaporable getter lines substantially mutually orthogonal to said support structure lines.

28. The method in accordance with claim 23, wherein forming said support structure lines and said non-evaporable getter lines at a predetermined angle to each other further comprises forming said support structure lines and said non-evaporable getter lines at an angle in the range from about 20 degrees to about 90 degrees.

29. A vacuum device manufactured accordance with claim 1.

30. A storage device manufactured in accordance with claim 1.

31. A display device having an electron emitter manufactured in accordance with claim 1.

32. A method of manufacturing a getter structure, comprising:

forming a first support structure disposed over a substrate;

forming a non-evaporable getter (NEG) layer, having an exposed surface area, disposed over said first support structure;

forming a second support structure disposed over said NEG layer;

forming a second NEG layer, having a second exposed surface area, disposed over said second support structure;

forming a vacuum gap between said substrate and said NEG layer, said NEG layer extending beyond said support structure increasing said exposed surface area; and forming a second vacuum gap between said NEG layer and said second NEG layer extending beyond said second support structure, increasing said second exposed surface area.

33. The method in accordance with claim 32, further comprising forming a base non-evaporable getter layer interposed between said first support structure and said substrate.

34. A method of manufacturing a getter structure, comprising steps for:

forming a first support structure disposed over a substrate;

forming a non-evaporable getter (NEG) layer disposed over said first support structure; and forming a vacuum gap between said substrate and said NEG layer.

35. The method in accordance with claim 34, further comprising step for forming a base non-evaporable getter layer interposed between said first support structure and said substrate.

36. The method in accordance with claim 34 further comprising steps for:

forming a second support structure disposed over said NEG layer;

forming a second NEG layer disposed over said second support structure; and forming a second vacuum gap between said NEG layer and said second NEG layer.

37. The method in accordance with claim 34, wherein:

said step for forming said support structure further comprises step for forming a plurality of support structure lines utilizing a non-NEG material, and substantially parallel to each other; and said step for forming said NEG layer further comprises step for forming a plurality of NEG lines substantially parallel to each other and at a predetermined angle to said plurality of support structure lines.

38. The method in accordance with claim 37, further comprising step for forming a plurality of second NEG lines substantially parallel to each other and at a second predetermined angle to said plurality of said NEG lines.

* * * * *